US011904916B2

(12) United States Patent
Bohe

(10) Patent No.: US 11,904,916 B2
(45) Date of Patent: Feb. 20, 2024

(54) SYSTEM AND METHOD FOR SHORT VEHICLE DETECTION

(71) Applicant: Siemens Mobility SAS, Chatillon (FR)

(72) Inventor: Armand Pierre Bohe, Bourg-la-Reine (FR)

(73) Assignee: Siemens Mobility SAS, Chatillon (FR)

( * ) Notice: Subject to any disclaimer, the term of this patent is extended or adjusted under 35 U.S.C. 154(b) by 0 days.

(21) Appl. No.: 17/949,394

(22) Filed: Sep. 21, 2022

(65) Prior Publication Data

US 2023/0092642 A1 Mar. 23, 2023

(30) Foreign Application Priority Data

Sep. 21, 2021 (EP) ..... 21306300

(51) Int. Cl.

| | |
|---|---|
| ***B61L 25/04*** | (2006.01) |
| ***B61L 23/06*** | (2006.01) |
| ***B61L 13/00*** | (2006.01) |
| ***B61L 25/02*** | (2006.01) |

(52) U.S. Cl.

CPC ..... *B61L 25/04* (2013.01); *B61L 13/00* (2013.01); *B61L 23/06* (2013.01); *B61L 25/02* (2013.01)

(58) Field of Classification Search

CPC ..... B61L 25/04; B61L 25/041; B61L 25/043; B61L 25/045; B61L 25/046; B61L 25/048; B61L 25/02; B61L 25/00; B61L 23/06; B61L 13/00; B61L 13/002; B61L 13/005; B61L 13/007; B61L 13/02; B61L 13/04; B61L 13/042; B61L 13/045; B61L 13/047

See application file for complete search history.

(56) References Cited

U.S. PATENT DOCUMENTS

| | | | | |
|---|---|---|---|---|
| 2007/0213890 | A1 | 9/2007 | Franckart et al. | |
| 2008/0149782 | A1* | 6/2008 | Tiwari | G01B 7/125 246/246 |
| 2012/0325979 | A1 | 12/2012 | Yoon | |

FOREIGN PATENT DOCUMENTS

| | | | |
|---|---|---|---|
| CN | 111551122 | A | 8/2020 |
| DE | 4436996 | C1 | 3/1996 |

* cited by examiner

*Primary Examiner* — Jacob M Amick

(74) *Attorney, Agent, or Firm* — Laurence A. Greenberg; Werner H. Stemer; Ralph E. Locher

(57) ABSTRACT

A system and a method automatically detect whether a vehicle entering a track section of a railway network is shorter than a predefined length. The method includes detecting at a time T0 an entry of the vehicle on a first track subsection. From the time T0, the occupancy states of at least a first subsection and a third subsection are determined in dependence on the time. The occupancy state is either "occupied" or "free". The occupancy states for at least first and third subsections is reported to an evaluation unit at least until the occupancy state of the first subsection is "free". The reported occupancy states determined for the at least first and third subsections are processed by the evaluation unit, and from a temporal evolution of the occupancy states of the first and third subsections, it is determined whether the entering vehicle is shorter than the predefined length.

15 Claims, 2 Drawing Sheets

FIG 3A

| | subsections | | | | | | | |
|---|---|---|---|---|---|---|---|---|
| Time | S1 | S2 | S3 | ... | Si | ... | $S_{N-1}$ | $S_N$ |
| T0 | occupied | free | free | | free | | free | free |
| T1 | occupied | occupied | free | | free | | free | free |
| T2 | free | occupied | free | | free | | free | free |
| T3 | free | occupied | occupied | | free | | free | free |
| T4 | free | free | occupied | | free | | free | free |
| ... | ... | ... | ... | ... | ... | ... | ... | ... |
| TN | free | free | free | ... | free | ... | free | occupied |

FIG 3B

| | subsections | | | | | | | |
|---|---|---|---|---|---|---|---|---|
| Time | S1 | S2 | S3 | ... | Si | ... | $S_{N-1}$ | $S_N$ |
| T0 | occupied | free | free | | free | | free | free |
| T1 | occupied | occupied | free | | free | | free | free |
| T2 | occupied | occupied | occupied | | free | | free | free |
| T3 | free | occupied | occupied | | free | | free | free |
| T4 | free | free | occupied | | free | | free | free |
| ... | ... | ... | ... | ... | ... | ... | ... | ... |
| TN | free | free | free | ... | free | ... | free | occupied |

SYSTEM AND METHOD FOR SHORT VEHICLE DETECTION

CROSS-REFERENCE TO RELATED APPLICATION

This application claims the priority, under 35 U.S.C. § 119, of European Patent Application EP 21306300.1, filed Sep. 21, 2021; the prior application is herewith incorporated by reference in its entirety.

FIELD AND BACKGROUND OF THE INVENTION

The present invention concerns a system and a method for the detection of a short vehicle on a railway network.

The present invention is essentially related to safety issues with respect to guided vehicles moving on a railway network. The wording "guided vehicle" refers to public transport means such as subways, trains or train subunits, tramways, etc., as well as load transporting means such as, for example, freight trains, for which safety is a very important factor and which are guided along a route or railway by at least one rail, in particular by two rails. We will simply refer hereafter to the guided vehicle using the term "vehicle".

Current railway signaling systems are configured for controlling the traffic on the railway network and for preventing collisions between vehicles moving on the railway network. For this purpose, they usually rely on some geometrical and dynamical assumptions regarding the vehicles moving on the railway network, wherein, in function of the assumptions, signals are controlled for enabling a safe displacement on the railway network.

One of these assumptions concerns notably the length of the vehicle. The signaling system considers for instance that all vehicles running on the railway network are characterized by a length that is greater than a predefined length L. However, in railway networks open to different types of traffics and vehicles, it may happen that a vehicle shorter than the predefined length L, for instance a maintenance vehicle, has to move on the railway network. This can perturbate the current traffic on the railway network, causing for instance performance or safety problems, and requiring from a railway network operator to activate or launch appropriate measures that will ensure the safety of the displacement of the vehicles on the railway network with respect to the short vehicle.

In order to notify the entry of such a short vehicle on the railway network, the short vehicle driver has to signal the entry to a railway network operator, using for instance communication means like a radio system or calling the operator using a phone. Such entry can also be notified by written or oral message from an operator controlling an upstream zone of the railway network wherein the short vehicle is currently located to an operator controlling a downstream zone of the railway network wherein the short vehicle has to go.

Unfortunately, such notifications do not prevent human errors, require a validation process by the operators, and are, as such, not efficient.

SUMMARY OF THE INVENTION

An objective of the present invention is to propose a system and a method capable of ensuring the safety of an entry of a short vehicle on a railway network by automatically detecting the entry on a track section of the railway network and preferentially automatically notifying the entry to a control system in charge of the control of the vehicle traffic on the track section.

For achieving the objective, the present invention proposes a method and a system as disclosed by the objects of independent claims. Other advantages of the invention are presented in the dependent claims.

The present invention proposes indeed a method for automatically detecting whether a vehicle entering a track section of a railway network is shorter than a predefined length L, the track section containing a first subsection S1, a second subsection S2 consecutive to the first subsection S1, and a third subsection S3 consecutive to the second subsection S2, wherein the first subsection S1 is separated from the third subsection S3 by the predefined length L. The predefined length L is thus the length of the second subsection S2. According to the present invention, two subsections are "consecutive" if they share a same boundary.

The method according to the invention contains notably the following steps:

detecting at a time T0 an entry of the vehicle on the first subsection S1. In the present case, we suppose that the vehicle is moving from the first subsection S1 in direction to the third subsection S3; from the time T0, determining, in dependence on the time, the occupancy states of at least the first subsection S1 and the third subsection S3, wherein the occupancy state is either "occupied" or "free". One considers notably that the nominal occupancy state of the first, second, and third subsection is free. This means that before a vehicle enters the first or the third subsection, the consecutive subsections S1-S3 are all in their nominal states. The present invention proposes then to determine a temporal evolution of the occupancy states of at least the first and third subsections by the system according to the invention. The temporal evolution is typically a temporal series of occupancy states for both the first and third subsections, showing for different times $T_i$ the occupancy state of both the first subsection S1 and the third subsection S3. It can be recorded for instance in a table, showing the occupancy states of each of the subsections in dependence on the time;

reporting or sending to an evaluation unit the determined occupancy states in function of the time for at least the first and third subsections. Preferentially, the determination of the occupancy states of the subsections S1 and S3 takes place at least until the occupancy state of the first subsection S1 is "free" again, i.e. changed back from occupied to free, or otherwise until the detected vehicle left the first subsection S1. Preferentially, the reporting of the occupancy states takes place also at least until the occupancy state of the first subsection S1 is "free" again. Preferentially, the determination and/or reporting automatically stop once the first subsection S1 changed its occupancy state from occupied to free;

processing by the evaluation unit the reported occupancy states in dependence on the time determined for the at least first and third subsections, and determining from a temporal evolution of the occupancy states of the first and third subsections, whether the entering vehicle is shorter than the predefined length L. For instance, it can determine whether it exists a time T_N>T0 at which both the first and the third subsections are characterized by the "free" occupancy state while the occupancy state of the third subsection S3 remained in its nominal state during the time interval [T0,T_N]. If such a time T_N exists, then the evaluation unit can automatically classify the vehicle as a short vehicle, and it can preferentially automatically notify the control system that the vehicle which entered the track section if is a short vehicle if it has been classified as such. For instance, the evaluation unit can output a signal indicating that the vehicle whose length has been evaluated as shorter than the predefined length has been detected entering on the subsection S1; preferentially, automatically notifying a control system in charge of the control of the vehicle traffic on the railway network about the entry of a short vehicle on the track section if the length of the entering vehicle has been evaluated as shorter than the predefined length L.

The present invention concerns also a system for automatically detecting whether a vehicle entering a track section of a railway network is shorter than a predefined length L. The system contains a detector system configured for determining an occupancy state by a vehicle of a first subsection S1 of the track section, wherein the occupancy state is either "occupied" or "free". The detector system being further configured for detecting at a time T0 an entry of the vehicle on the first subsection S1 and for reporting or sending to an evaluation unit, from the time T0 and notably at least until the occupancy state of the first subsection S1 switches from the current occupied state due to the detection of the vehicle to the "free" occupancy state indicating that the vehicle left the first subsection S1, the occupancy state of the first subsection S1 in function of the time. As explained earlier, we consider here that the vehicle is moving from the first subsection S1 in direction to the third subsection S3 and that the nominal occupancy state of the subsections is "free". For a movement of the vehicle from the third subsection S3 towards the first subsection, the presently described concept applies mutatis mutandis. The detector system is further configured for determining an occupancy state of the third subsection S3 of the track section, wherein the first subsection S1 is separated from the third subsection S3 by the second subsection S2 whose length is the predefined length L. As explained earlier, the second subsection S2 is consecutive to the first subsection S1 and third subsection S3 is consecutive to the second subsection S2. The detector system is further configured for reporting or sending to the evaluation unit, from the time T0 and notably at least until the occupancy state of the first subsection S1 changes from "occupied" to "free", the occupancy state of the third subsection S3 in function of the time. Preferably, the detector system contains a first detector D1 and a third detector D3, wherein the first detector D1, respectively the third detector D3, is configured for determining the occupancy state by a vehicle of the first subsection S1, respectively third subsection S3, of the track section, the first detector D1 being further configured for detecting the time T0 corresponding to an entry of the vehicle on the first subsection S1. Preferentially, the detection of the vehicle entry on the first subsection S1 triggers the start of the determination of the occupancy state in function of the time by both detectors D1 and D3 of their respective subsections. The evaluation unit is configured for receiving from the detector system, e.g. from each detector D1 and D3, the determined occupancy states in function of the time and for determining from a temporal evolution of the occupancy states of the first and third subsections, whether the entering vehicle is shorter than the predefined length L. For instance, it can be configured for determining whether it exists a time T_N>T0 at which both the first and the third subsections are characterized by the "free" occupancy state and the occupancy state of the third subsection S3 remained its nominal occupancy state during the time interval [T0,T_N]. In particular, if such a time T_N exists, then the evaluation unit automatically classifies the detected vehicle as short vehicle. Preferentially, the evaluation unit is further configured for automatically notifying a control system in charge of controlling the vehicle traffic on the railway network that the vehicle whose entry on the first subsection S1 has been detected is a short vehicle, i.e. a vehicle whose length is shorter than the predefined length L.

Preferentially, the detector system according to the invention is configured for determining an occupancy state of the second subsection S2 by a vehicle. For this purpose, it may contain a second detector D2 configured for determining said occupancy state of S2. The detector system is then configured for reporting to the evaluation unit the occupancy state of the second subsection S2 in function of the time. For instance, the system according to the invention might be configured for determining, from the time T0 and in dependence on the time, the occupancy states of the first, second and third subsections S1, S2, S3, then for reporting to the evaluation unit 3 the occupancy states of the first, second, and third subsections in function of the time notably at least until the occupancy state of said first section S1 changed from "occupied" to "free". The evaluation unit 3 is then configured for determining if it exists a time T_N' at which the second subsection is "occupied" while the first and third subsections are "free". If such a time T_N' exists, which is actually equivalent to the time T_N, then the evaluation unit may automatically classify the detected vehicle as short vehicle. Preferentially, the evaluation unit might be further configured for automatically signaling to an operator or control center that the vehicle which has been detected entering on the first subsection S1 is a short vehicle.

According to the present invention, the detector system might be configured for determining the occupancy state in function of the time of additional consecutive subsections, for instance from a whole set $S=\{S_1, \ldots, S_N\}$ of subsections. For this purpose, the detector system according to the invention may comprise one or several additional detectors $D_4$-$D_N$. Each additional detector $D_j$, j=4, . . . ,N, is notably configured for determining the occupancy state of an additional subsection $S_j$ and for reporting to the evaluation unit, from the time T0, the occupancy state of the additional subsection $S_j$ in function of the time. The reporting and/or determination may take place at least until the occupancy state of the first subsection S1 is "free". Preferentially, it takes place until the vehicle entered the last subsection SN or left the latter, i.e. until the occupancy state of the last subsection SN changed from free to occupied, or from occupied to free. The subsection $S_4$ is in particular consecutive to the subsection $S_3$, and each subsection $S_k$ is consecutive to the subsection $S_{k+1}$ for k=1, . . . ,N−1. In such a case, the evaluation unit is configured for receiving from each detector the temporal evolution of the occupancy states of the subsection for which the detector is responsible for. The evaluation unit is notably configured for determining whether the vehicle which entered the first subsection $S_1$ is a short vehicle from a processing of the temporal evolution of all reported occupancy states.

The present invention proposes thus to determine at different times $T_i$ the occupancy state of a plurality of subsections, wherein at least the temporal evolution or sequence of successive occupancy states of two subsections directly bordering a subsection of length L is acquired and processed by the evaluation unit for determining whether a vehicle is shorter than the length L or not. In order to increase safety, a determination, by the detector system according to the invention, of the temporal evolution of occupancy states of several couples of subsections might be performed, wherein each couple directly flanks such a subsection of length L. Optionally, the occupancy state determination by the detector system might be performed for different couples of subsections, wherein each couple directly flanks a subsection of a different predefined length, e.g. L1 for a first couple, L2 for a second couple, etc., enabling thus to determine within which range of lengths the entering vehicle is comprised with.

Other features which are considered as characteristic for the invention are set forth in the appended claims.

Although the invention is illustrated and described herein as embodied in a system and a method for short vehicle detection, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE FIGURES

FIGS. 3A-3B are tables showing occupancy states as a function of time for a short vehicle and a long vehicle.

DETAILED DESCRIPTION OF THE INVENTION

Figure 1:
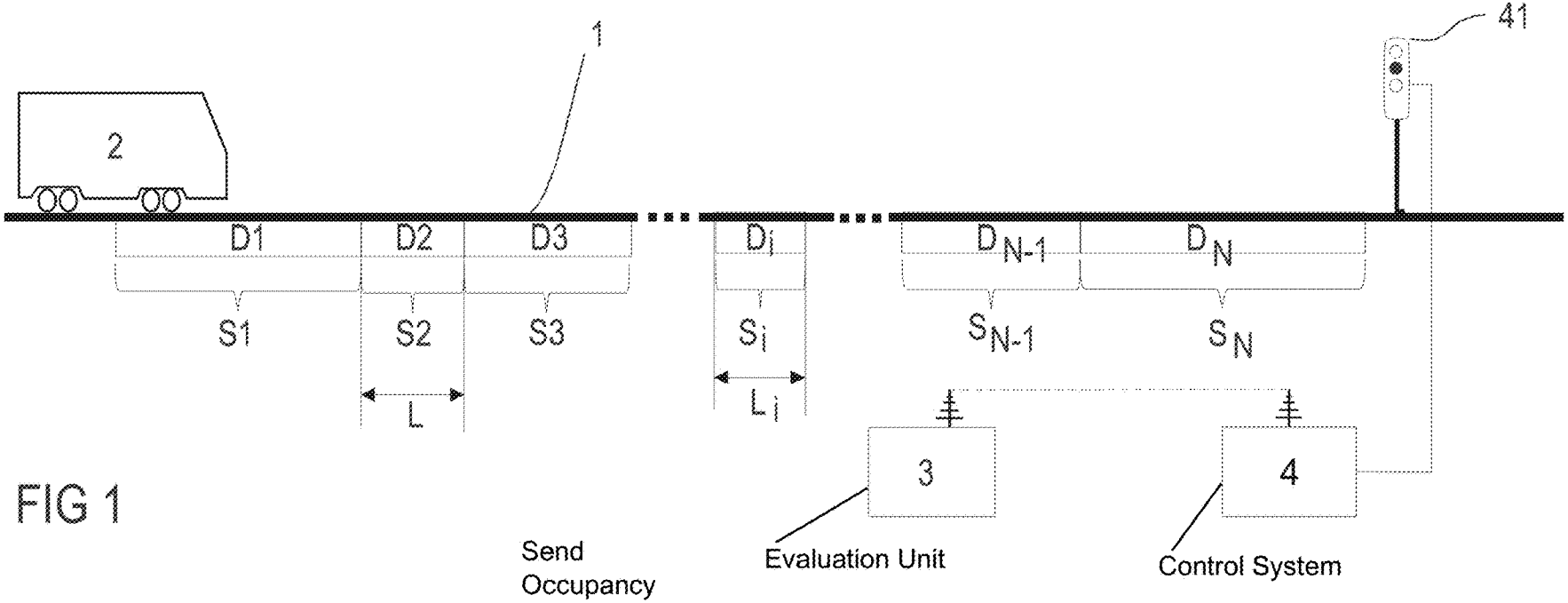
FIG. 1 is schematic representation of a system for detecting a short vehicle according to the invention.
Figure 2:
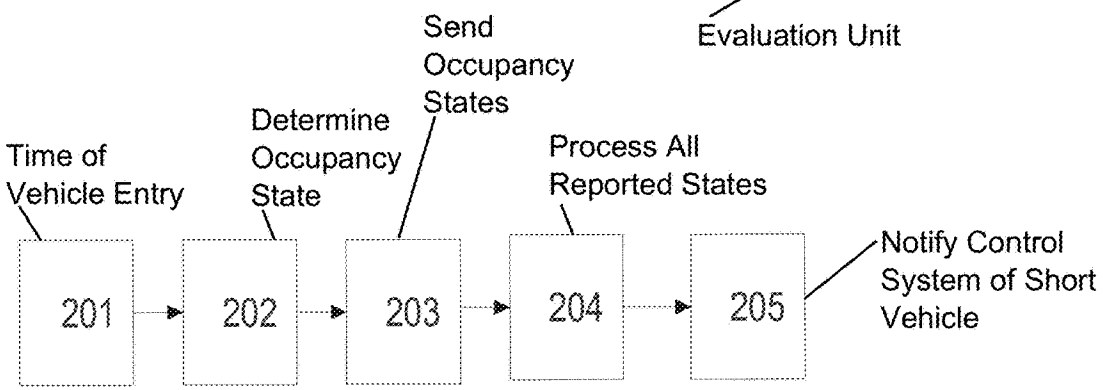
FIG. 2 is a block diagram of a method for detecting a short vehicle according to the invention.

Referring now to the figures of the drawings in detail and first, particularly to FIGS. 1 and 2 thereof, there is shown preferred embodiments of a method and a system for automatically detecting a short vehicle entering on a track section. FIGS. 3A and 3B illustrates temporal sequences of occupancy states that are determined by the detector system according to the invention for subsections of the track section.

FIG. 1 shows a track section 1 of a railway network on which a vehicle 2, for instance a train or metro, can move. The present invention proposes to automatically detect whether a length of the vehicle 2 entering a first subsection $S_1$ is shorter than a predefined length L. For this purpose, a portion of the track section is divided in consecutive subsections $S_1, \ldots, S_N$, wherein each subsection $S_1$ shares a boundary with a directly next subsection $S_{p+1}$, with p=1, . . . ,N−1, and wherein the occupancy state of part or all subsections is determined by the detector system. For instance, each subsection $S_j$, i=1, . . . ,N, might be associated to a detector $D_i$ of the detector system, wherein the detector $D_i$ is configured for determining the occupancy state of the subsection $S_i$, and thus also, and in particular, to detect whether a vehicle entered the subsection $S_i$. However, all subsections do not need to be associated to a detector, i.e. the occupancy state in function of the time of all consecutive subsections does not need to be determined by the detector system. Indeed, it suffices that the occupancy states of at least one couple of subsections directly flanking, each on one side, a subsection whose length equals the predefined length L is determined for enabling to evaluate whether the vehicle moving on the couple of subsections is shorter than the predefined length L. For instance, a first detector $D_1$ is configured for determining the occupancy state of a first subsection $S_1$, optionally a second detector $D_2$ is configured for determining the occupancy state of a second subsection $S_2$, and a third detector $D_3$ is configured for determining the occupancy state of a third subsection, the length of the second subsection $S_2$ being the predefined length L. From the temporal evolution of the occupancy states of the subsections $S_1$ and $S_3$, the system according to the invention is then already able to determine whether the length of the vehicle 2 is shorter than L. Getting the occupancy states of the second subsection $S_2$ by the detector system, e.g. by detector $D_2$, is thus optional, but may increase the safety of the system. Therefore, the occupancy state by a vehicle 2 of some or all of the consecutive subsections $S_i$ might be determined by the detector system, e.g. by its detectors $D_i$.

The detector system might use different techniques for determining the occupancy state of the subsections, and thus the presence of a vehicle on a subsection. For instance it can use track circuits, or axle counters, or a set of light barriers containing for each boundary of each subsection at least one light barrier of the set, or a camera system configured of imaging a length of the track section containing at least the first, second and third subsections, and an image analysis system capable of determining from the acquired images the temporal evolution of the occupancy states of the subsections $S_1$-$S_3$ when the vehicle 2 entering the first subsection S1 is detected in an image acquired by a camera of the camera system. A detector according to the invention is thus a device or system capable of detecting the presence of a vehicle on a subsection. It can be an axle counter or a track circuit. The detector can use other techniques. In particular, a same detector might be able to determine the occupancy state of several subsections. This is the case for instance if the detector is a camera of the camera system.

While the concept according to the invention requires that at least two subsections (i.e. a pair or couple of subsections), e.g. $S_1$ and $S_3$, directly flanking another subsection of length L, e.g. $S_2$, each one located on one different side of the another subsection, have their occupancy state determined by the detector system, e.g. each one by a different detector, or each one by a same detector, for enabling an evaluation of the length of the vehicle 2 (e.g. the length being shorter than the predefined length L or not), FIG. 1 presents a non-limiting example wherein a plurality or all subsections $S_i$ are associated to a detector $D_i$. As shown in FIG. 1, there might be one or several other subsections $S_i$ whose length $L_i$ is predefined, e.g. equal to the predefined L, or equal to a length L1 greater than L, or equal to a length L2 smaller than L, so that the length of the detected vehicle 2 might be more precisely determined using the concept according to the invention, for instance by determining by means of the evaluation unit 3 whether it is comprised between L2 and L, or between L and L1.

Preferentially, each detector $D_i$ according to the invention is configured for determining the occupancy state of the subsection $S_i$ it is responsible for, and then for automatically sending or reporting to an evaluation unit 3 the occupancy state. It can send or report continuously the occupancy state, or periodically, starting to report as soon as a vehicle is detected on the first subsection S1 of the consecutive set of subsections $S_i$. The detection by the first detector $D_1$ of the vehicle 2 entering the subsection S1 might be used for triggering the determination of the occupancy state in function of the time and their reporting by all other detectors. For instance, the first detector D1 may send a signal to all other detectors that are responsible for determining the occupancy state of at least one of the consecutive subsections, the signal being configured for launching the determination of the occupancy state in function of the time by the other detectors.

Each occupancy state is associated to a date or time value which enables the evaluation unit 3 to determine the temporal evolution of the occupancy states of each subsection for which it receives the occupancy states. Preferentially, as soon as the detector system detects a presence of a vehicle on the first subsection $S_1$, i.e. detects the entry of the vehicle on $S_1$, for instance via its detector $D_1$, then it starts acquiring the occupancy state in function of the time of all other subsections for which it is responsible for. For instance, once $D_1$ detects a presence of a vehicle on S1, then all other detectors which are responsible for determining the occupancy state in function of the time of at least another subsection $S_i$ of the set of consecutive subsections, e.g. $D_3$, also starts to report the occupancy states in function of the time for each subsection it is responsible for. In other words, when considering a set of consecutive subsections and an associated set of detectors as previously described, the detection of an entry of a vehicle on the first subsection when the vehicle is moving in direction of the last subsection, or on the last subsection when the vehicle is moving in direction of the first subsection, is configured for triggering the sending or reporting by all detectors of the occupancy state in function of the time of the subsection(s) they are responsible for to the evaluation unit. Preferably, the sending or reporting is automatically stopped as soon as the evaluation unit 3 evaluated the length of the entering vehicle 2.

The evaluation unit 3 is configured for processing the received occupancy states in function of the time and for evaluating, from the latter, the length of the vehicle 2. FIG. 3A shows for instance reported occupancy states in function of the time for a short vehicle and FIG. 3B shows for instance reported occupancy states in function of the time for a long vehicle. The difference between the two tables can be found for time T2: in FIG. 3A, the evaluation unit is capable of identifying the time T2 at which S1 and $S_3$ are free while S2 is occupied, and from the identification it is able to conclude that the vehicle 2 is shorter than the predefined length. At the opposite, in FIG. 3B, the evaluation unit 3 cannot identify a time $T_i$ at which the occupancy state of the subsection $S_3$ remains free while the occupancy state of the subsection $S_1$ changed from occupied to free. Therefore, according to the table of FIG. 3B, the vehicle is longer than the predefined distance L. Preferentially, the evaluation unit 3 may store, for instance in a database, predefined sequences of temporal evolutions of the occupancy states of the subsections wherein each sequence is associated to a length or a length characteristic of the vehicle, wherein the length or length characteristic is configured for being associated to the vehicle whose moving on the subsections generates a temporal evolution of the occupancy states that corresponds to the concerned predefined sequence. For example, the sequence [(T0, occupied, free, free), (T1, occupied, occupied, free), (T2, free, occupied, occupied)] might be used for encoding "length of the vehicle shorter than the predefined length". Other sequences might be then defined, wherein each sequence is configured for characterizing the length of the detected vehicle, enabling to determine for instance whether the length is comprised between L2 and L, or between L and L1. In particular, the track section 1 might be divided in a set of consecutive subsections $S_1$-$S_N$ having each a different length and the evaluation unit might comprise a table of predefined sequences of temporal evolutions of the occupancy states of the consecutive subsections $S_1$-$S_N$ in function of a vehicle length, i.e. each predefined sequence might be associated to a vehicle length, the evaluation unit being then configured for comparing an acquired or received temporal evolution of the occupancy states of the consecutive subsections resulting from the moving of a vehicle on the subsections $S_1$-$S_N$, to the predefined sequences of the table, and identifying the predefined sequence matching the acquired or received temporal evolution, and providing as output the vehicle length associated to the matching predefined sequence. The evaluation unit might further automatically determine whether the outputted vehicle length satisfies length requirements of the railway network, and in the negative, it can automatically inform the control system or an operator about the detection of the vehicle failing to satisfy the length requirements.

Even if the occupancy state of the subsection $S_2$ cannot or is not determined by the detector system, the evaluation unit 3 can still determine whether the vehicle is shorter or not than the predefined length L from the temporal evolution of the occupancy states of the directly neighboring subsections $S_1$ and $S_3$. Indeed, the evaluation unit 3 is configured for automatically determining:

- if a time T_N>T0 at which the occupancy state of both the first and the third subsections is "free" exists, and
- if the occupancy state of the third subsection $S_3$ remained its nominal occupancy state during the whole interval of time [T0,T_N],
- and if such a time T_N exists and the occupancy state of $S_3$ remained its nominal state, then the evaluation unit 3 is configured for signaling that the detected vehicle 2 has a length shorter than the predefined length. Indeed, if one of the above-mentioned "if"-condition is not true, then it means that the detected vehicle is longer than the predefined length.

The method according to the invention will now be described in more details with respect to FIG. 2, together with FIG. 1. A portion of the track section contains N consecutive subsections $S_1$–$S_N$, with N>2, and the occupancy state as a function of the time of at least two subsections flanking a subsection of length equal to the predefined length L is determined by the detector system according to the invention. Let's consider the vehicle 2 entering the first subsection 51 and moving in direction of the last subsection $S_N$ as shown in FIG. 1. The method according to the invention includes the now describes steps.

At step 201, the detector system, for instance its detector D1, detects at a time T0 an entry of the vehicle 2 on the first subsection $S_1$. The detection might correspond to the change of the occupancy state of the first subsection S1 from its nominal occupancy state "free" to the occupancy state "occupied". This change typically takes place at T0 when the vehicle 2 enters the subsection 51 and corresponds to the detection of the vehicle 2 starting to move on the first subsection $S_1$.

At step 202, from the time T0, the detector system determines, as a function of the time, the occupancy states of at least two subsections that are directly flanking a subsection characterized by a length equal to the predefined length L. For instance, it determines the occupancy states of at least the subsections $S_1$ and $S_3$ in function of the time. Preferentially, it also determines the occupancy states as a function of the time of the subsection characterized by a length equal to the predefined length L, for instance $S_2$. It can also start, at the time T0 or at a later time, to determine the occupancy state of another pair of subsections among the subsections $S_1$-$S_N$, wherein the another pair comprises subsections that are directly flanking another subsection characterized by a length equal to the predefined length L or characterized by a length equal to another predefined length $L_i$. It can for instance acquire the occupancy states of at least the directly neighboring subsections $S_{i-1}$ and $S_{i+1}$ of the subsection $S_i$, wherein the subsection $S_i$ is characterized by a length equal to L1. The detector system can for instance determine or acquire the occupancy state in function of the time of each of the subsections $S_1$-$S_N$ for which it is configured to determine such an occupancy state. For this purpose, it can use a set of detectors $D_i$. In particular, each detector $D_i$ is configured for determining the occupancy state of one subsection $S_i$, or of a set of subsections.

At step 203, the detection system reports or sends to the evaluation unit 3, for instance in real time, the occupancy states in function of the time for the at least two subsections that are directly flanking the subsection characterized by the length equal to the predefined length L. Additionally, it can also report or send to the evaluation unit 3, the occupancy states in function of the time of the another pair of subsections that are directly flanking the another subsection characterized by a length equal to L or Li. For instance, it can report or send to the evaluation unit the occupancy state in function of the time of the subsections $S_1$ and $S_3$, and/or, of the subsections $S_{i-1}$ and $S_{i+1}$. Preferentially, it also sends or reports to the evaluation unit 4 the occupancy states in function of the time of $S_2$ and/or $S_i$. The sending or reporting takes place preferentially at least until the subsection $S_{i-1}$ changes back its occupancy state from occupied to free, and then, it can automatically stop. For instance, the sending of the occupancy states of $S_1$ and $S_3$ automatically stops once the subsection $S_1$ changes its occupancy state from occupied to free. Preferentially, the reporting or sending takes place until the vehicle 2 reaches the last subsection $S_N$ and stops when it leaves the last subsection $S_N$.

At step 204, the evaluation unit 3 processes all reported or received occupancy states in function of the time. For this purpose, the evaluation unit 3 typically contains one or several processors and a memory configured for processing the occupancy states in function of the time. Preferentially, each occupancy state is associated to a time data which enables the evaluation unit to acquire or determine the temporal evolution of the occupancy states as shown for instance in FIGS. 3A and 3B. It can for instance determine the temporal evolution of the occupancy states of the subsections S1 and $S_3$, and/or, $S_{i-1}$ and $S_{i+1}$. The evaluation unit 3 is further configured for determining, from the temporal evolutions, e.g. of the occupancy states of $S_i$ and $S_3$, and/or, $S_{i-1}$ and $S_{i+1}$ whether the detected vehicle is a vehicle whose length is shorter than the predefined length L. Additionally, if the subsection $S_i$ is characterized by a length $L_i$, it can also determine if the length of the vehicle is shorter than $L_i$ or not.

At step 205, and optionally, the evaluation unit 3 automatically notifies the control system 4 in charge of vehicle traffic management for the railway network that the detected vehicle 2 is a short vehicle. Preferentially, the system according to the invention is part of the control system 4, the latter containing also for instance a signaling system. Upon reception of the notification of short vehicle regarding the entry of vehicle 2 on the track section 1, the control system might be configured for taking automatically appropriate measures, notably by controlling the signaling system, for instance its signal 41. It can for instance automatically set the signal 41 for preventing the vehicle 2 moving forward, i.e. passing the signal 41. Alternatively or additionally, the evaluation unit 3 may automatically send an alarm to an operator of a control center if a short vehicle is detected.

As previously explained, the consecutive subsections might comprise not only a single subsection of predefined length L, but other subsections having a length that is equal to the predefined length L and/or other subsections having a length that is different from the predefined length L, e.g. shorter than L. For instance, if within the set of consecutive subsections $S_1$-$S_N$, the subsection $S_2$ is characterized by a length L, then at least one of the consecutive subsections $S_3$-$S_{N-1}$—called hereafter $S_i$—might have a length equal to a predefined length $L_i$ which is used for approximating the length of the vehicle. $L_i$ might be equal (for redundant calculations) or different from L. In such a case, the method may comprise determining by the evaluation unit 3 whether a time T_M>T0 exists, at which both directly neighboring subsections of $S_i$ are in a free occupancy state after the directly neighboring subsection that had been occupied first, i.e. $S_{i-1}$, changed its occupancy state from occupied to free, while the other neighboring subsection always remained in its nominal occupancy state during the time interval [T0, T_M].

To summarize, the present invention proposes a method and a system for automatically detecting whether a vehicle 2 entering a track section 1 of a railway network is shorter than a predefined length L, the determination being based on the acquisition and processing of occupancy states of subsections of the track section, wherein the temporal evolution of the occupancy states of at least two subsections which are flanking a subsection characterized by a length equal to the predefined length is analyzed by an evaluation unit, which is notably configured for outputting a signal indicating whether the detected vehicle is shorter than the predefined length L.

The invention claimed is:

1. A method for automatically detecting whether a vehicle entering a track section of a railway network is shorter than a predefined length L, the track section having subsections including a first subsection, a second subsection consecutive to the first subsection, and a third subsection consecutive to the second subsection, wherein a length of the second subsection is equal to the predefined length L, the method comprises the following steps of:

detecting at a time T0 an entry of the vehicle on the first subsection;

determining, from the time T0, as a function of time, occupancy states of at least the first subsection and the third subsection, wherein an occupancy state is either "occupied" or "free";

reporting to an evaluation unit the occupancy states as a function of time;

processing by the evaluation unit the occupancy states as a function of time determined for the at least first and third subsections, and determining, from a temporal evolution of the occupancy states of the first and third subsections, whether the vehicle is shorter than the predefined length L; and if the vehicle is shorter than the predefined length L, then automatically notifying a control system in charge of a control of vehicle traffic on the railway network about the entry on the first track section of the vehicle which is shorter than the predefined length L.

2. The method according to claim 1, which further comprises determining from the temporal evolution of the occupancy states of the first and third subsections whether the vehicle entering is shorter than the predefined length L by the further steps of:

determining whether there exists a time T_N>T0 at which both the first and the third subsections are characterized by the "free" occupancy state and the occupancy state of the third subsection remained "free" during a time interval [T0,T_N], and if the time T_N>T0 exists, classifying the vehicle as a short vehicle; and automatically signaling to the control system that the vehicle detected is the short vehicle if it has been classified as such.

3. The method according to claim 1, which further comprises:

determining, from the time T0 and as a function of the time, the occupancy states of the second subsection;

reporting to the evaluation unit the occupancy states as a function of the time of the second subsection;

determining if there exists a time T_N' at which the second subsection is "occupied" while the first and third subsections are "free" and if the time T_N' exists then automatically notifying the control system that the vehicle detected is a short vehicle.

4. The method according to claim 1, which further comprises:

reporting, from the time T0, the occupancy state of one or several additional consecutive subsections S4-SN as a function of the time; and determining by the evaluation unit whether the vehicle is a short vehicle from processing all reported said occupancy states.

5. The method according to claim 4, wherein at least one of consecutive subsections $S_3$-$S_{N-1}$ of the track section, called hereafter $S_i$, is characterized by the predefined length L, the method further comprises:

determining by the evaluation unit whether a time T_M>T0 exists, at which both directly neighboring subsections of the subsection $S_i$ are in a free occupancy state after a directly neighboring subsection that had been occupied first, changed its occupancy state from occupied to free, while another neighboring subsection always remained "free" during a time interval [T0, T_M].

6. The method according to claim 4, wherein at least one of the consecutive subsections $S_3$-$S_{N-1}$ of the track section is characterized by another predefined length L' being shorter than the predefined length L, and wherein the evaluation unit is configured for automatically determining whether a length of the vehicle is greater than L, comprised between L and L', or shorter than L' from its processing of the reported occupancy states.

7. The method according to claim 1, which further comprises storing predefined sequences of temporal evolutions of the occupancy states of the subsections and associating to each of the predefined sequences a vehicle length or length characteristic, the method further comprises:

comparing a temporal evolution of received occupancy states to the predefined sequences and identifying the one that matches the temporal evolution of a received occupancy states and associating to a detected vehicle a vehicle length or length characteristic of a matching predefined sequence.

8. A system for automatically detecting whether a vehicle entering a track section of a railway network and moving from a first subsection in direction to a third subsection is shorter than a predefined length L, the system comprising:

an evaluation unit;

a detector system configured for determining an occupancy state by the vehicle of the first subsection and of the third subsection of the track section, wherein the occupancy state is either "occupied" or "free", said detector system further configured for detecting at a time T0 an entry of the vehicle on the first subsection and for reporting to said evaluation unit, from said time T0, the occupancy state of the first subsection and of the third subsection as a function of time, the first subsection being separated from the third subsection by a second subsection whose length is the predefined length L; and said evaluation unit configured for receiving from said detector system the occupancy states as a function of the time and for determining from a temporal evolution of the occupancy states of the first and third subsections, whether the vehicle entering is shorter than the predefined length L, and if the vehicle has been determined to be shorter than the predefined length L, then said evaluation unit is configured to automatically notifying a control system in charge of controlling vehicle traffic on the railway network that the vehicle whose entry on the first subsection has been detected is a short vehicle.

9. The system according to claim 8, wherein said evaluation unit is configured for determining whether there exists a time T_N at which both the first and the third subsections are characterized by the "free" occupancy state, and the occupancy state of the third subsection remained in its nominal state during a time interval [T0,T_N].

10. The system according to claim 8, wherein said detector system is configured for determining as a function of the time the occupancy state of the second subsection, and for reporting to said evaluation unit, from the time T0, the occupancy state of the second subsection as a function of the time, said evaluation unit is further configured for determining whether there exists a time T_N' at which the second subsection is "occupied" while the first and third subsections are "free" and if the time T_N' exists, then automatically notifying the control system that the vehicle is a short vehicle.

11. The system according to claim 8, wherein:

said detector system is configured for determining the occupancy state of one or several additional consecutive subsections S4-SN of the track section and for reporting, from the time T0, the occupancy state of each additional subsection $S_i$, j=4, . . . ,N as a function of the time; and said evaluation unit is configured for determining whether the vehicle detected is a short vehicle from processing all reported occupancy states, the additional subsections S4-SN being consecutive subsections, S4 being a subsection consecutive to the third subsection $S_3$.

12. The system according to claim 11, wherein at least one of the consecutive subsections $S_3$-$S_{N-1}$, called hereafter $S_i$, is characterized by the predefined length L, said evaluation unit is configured for determining whether a time T_M exists, at which both directly neighboring subsections of $S_i$, namely $S_{i-1}$ and $S_{i+1}$, are in a free occupancy state after a directly neighboring subsection that had been occupied first, changed its occupancy state from occupied to free, while another neighboring subsection always remained in a free occupancy state during a time interval [T0,T_M].

13. The system according to claim 11, wherein at least one of the consecutive subsections $S_3$-$S_{N-1}$ is characterized by another predefined length L' being shorter than the predefined length L, and wherein said evaluation unit is configured for automatically determining whether a length of the vehicle is greater than L, comprised between L' and L, or shorter than L' from a processing of the reported occupancy states.

14. The system according to claim 8, wherein said evaluation unit has a database storing predefined sequences of temporal evolutions of the occupancy states of the subsections, wherein each of the predefined sequences is associated to a vehicle length or length characteristic, said evaluation unit is configured for comparing a temporal evolution of received occupancy states to the predefined sequences and identifying the one that matches the temporal evolution of the received occupancy states, and for associating to the vehicle detected the vehicle length or the length characteristic of the a predefined sequence.

15. A control system for controlling and managing a traffic of vehicles over a track section of a railway network, the control system comprising:

a signaling system;

the system according to claim 8;

a control system configured for automatically controlling said signaling system in dependence on a notification of short vehicle sent by said system for the vehicle detected.

* * * * *